US011007534B2

(12) United States Patent
Belke et al.

(10) Patent No.: US 11,007,534 B2
(45) Date of Patent: May 18, 2021

(54) STIRRED BEAD GRINDING MILLS

(71) Applicants: OUTOTEC (FINLAND) OY, Espoo (FI); SWISS TOWER MILLS MINERALS AG, Baden (CH)

(72) Inventors: Jeff Belke, West Perth (AU); Alex Heath, Leeming Perth (AU); Edward Allan Jamieson, Bayswater (AU)

(73) Assignees: OUTOTEC (FINLAND) OY, Espoo (FI); SWISS TOWER MILLS MINERALS AG, Baden (CH)

( * ) Notice: Subject to any disclaimer, the term of this patent is extended or adjusted under 35 U.S.C. 154(b) by 0 days.

(21) Appl. No.: 16/516,292

(22) Filed: Jul. 19, 2019

(65) Prior Publication Data

US 2019/0358638 A1 Nov. 28, 2019

Related U.S. Application Data

(63) Continuation of application No. PCT/FI2017/050042, filed on Jan. 26, 2017.

(51) Int. Cl.
*B02C 17/16* (2006.01)
*B02C 17/22* (2006.01)

(52) U.S. Cl.
CPC ..... *B02C 17/16* (2013.01); *B02C 17/22* (2013.01)

(58) Field of Classification Search
CPC ..... B02C 17/16; B02C 17/22; B02C 17/163; B02C 2017/165; B01F 7/0075;
(Continued)

(56) References Cited

U.S. PATENT DOCUMENTS 4,174,074 A * 11/1979 Geiger ..... B02C 17/16 241/172
5,379,952 A 1/1995 Geiger
(Continued)

FOREIGN PATENT DOCUMENTS

DE 202014102338 U1 6/2014
GB 1024053 A 3/1966
(Continued)

OTHER PUBLICATIONS

International Search Report issued by Finnish Patent and Registration Office acting as the International Searching Authority in relation to International Application No. PCT/FI2017/050042 dated Apr. 19, 2017 (4 pages).
(Continued)

*Primary Examiner* — Debra M Sullivan
*Assistant Examiner* — Matthew Kresse
(74) *Attorney, Agent, or Firm* — Robert P. Michal, Esq.; Carter, DeLuca & Farrell LLP

(57) ABSTRACT

A stirred bead grinding mill includes a substantially cylindrical grinding shell and a central stirring shaft within the grinding shell. The central stirring shaft is provided with axially spaced stirring elements, preferably grinding discs, along the central stirring shaft. A replaceable grinding element is provided that includes an axial support structure arranged to form the outer periphery of the grinding element adapted to fit within the grinding shell, and at least one counter disc arranged to project radially inward from the axial support structure to an extent separating two grinding zones in an axial direction while allowing the central stirring shaft within the grinding shell, wherein at least part of the counter disc and/or the support structure is provided with castellations.

20 Claims, 11 Drawing Sheets

(58) Field of Classification Search
CPC .. B01F 7/00758; B01F 7/00775; B01F 7/008; B01F 7/00816; B01F 7/00808; B01F 7/025; B01F 7/10; B01F 7/1675; B01F 7/169; B01F 7/26; B01F 15/00883; B01F 15/00889; B01F 15/00909; B01F 15/00915
USPC ..... 241/5
See application file for complete search history.

(56) References Cited

U.S. PATENT DOCUMENTS

| | | | | |
|---|---|---|---|---|
| 5,516,051 | A * | 5/1996 | Brisbois | B02C 17/225 241/172 |
| 6,021,969 | A * | 2/2000 | Schmitt | B01F 7/0075 241/171 |
| 2009/0020638 | A1* | 1/2009 | Becker | B02C 4/305 241/291 |
| 2014/0008473 | A1* | 1/2014 | Yanase | B02C 17/182 241/79.3 |

FOREIGN PATENT DOCUMENTS

| | | | |
|---|---|---|---|
| JP | 3945717 | B1 | 7/2007 |
| JP | 2008104910 | A | 5/2008 |

OTHER PUBLICATIONS

Written Opinion of the International Searching Authority issued by Finnish Patent and Registration Office acting as the International Searching Authority in relation to International Application No. PCT/FI2017/050042 dated Apr. 19, 2017 (6 pages).
International Preliminary Report on Patentability issued by European Patent Office acting as the International Preliminary Examining Authority in relation to International Application No. PCT/FI2017/050042 dated Jan. 23, 2019 (6 pages).
Chilean Office Action issued by the Chilean Patent Office in relation to Chilean Application No. 201902038 dated Mar. 13, 2020 (15 pages).
Chilean Search Report issued by the Chilean Patent Office in relation to Chilean Application No. 201902038 dated Mar. 13, 2020 (2 pages).

* cited by examiner

STIRRED BEAD GRINDING MILLS

CROSS-REFERENCE TO RELATED APPLICATIONS

This application is a continuation of PCT International Application No. PCT/FI2017/050042 filed Jan. 26, 2017, the disclosure of this application is expressly incorporated herein by reference in its entirety.

FIELD OF THE INVENTION

The invention relates to improvements in stirred bead grinding mills for grinding mineral ore particles.

BACKGROUND OF THE INVENTION

Stirred bead grinding mills are typically used in mineral processing to grind mineral ore particles into smaller sized particles to facilitate further downstream processing, such as separation of the valuable mineral particles from unwanted gangue. For example, mineral ore particles in the range of about 30 μm to 4000 μm in diameter may be ground down to particles of 5 to 100 μm in diameter.

A stirred bead grinding mill typically has a stationary mill body or shell arranged vertically in the mill and an internal drive shaft. The drive shaft has a plurality of stirring elements, such as grinding discs or rotors, so that rotation of the drive shaft also rotates the stirring elements, which in turn stirs a suitable grinding media, and the mineral ore particles, in the form of a feed slurry, passes through this stirred bed of media. The resulting stirring action causes the mineral ore particles to be ground into smaller sized particles. However, the grinding discs and the shell tend to suffer from high wear, especially when the grinding mill is operated at high speeds through the action of the harder grinding media acting against the grinding discs.

BRIEF DESCRIPTION OF THE INVENTION

An aspect of the invention is a grinding element for a stirred bead grinding mill used in grinding mineral ore particles having a preferably cylindrical grinding shell and a central stirring shaft within the grinding shell, wherein the grinding element comprises an axial support structure arranged to form the outer periphery of the grinding element adapted to fit within the grinding shell, and at least one counter disc arranged to project radially inward from the axial support structure to an extent separating two grinding zones in an axial direction while allowing the central stirring shaft within the grinding shell, wherein at least part of the counter disc and/or the support structure is provided with castellations.

In an embodiment, the grinding element has a cross-section of a hollow cylinder or an arc segment of a hollow cylinder, preferably a cross-section of an arc segment in a range from 20 degrees to 180 degrees of a hollow cylinder, more preferably a cross-section of a hollow half-cylinder.

In an embodiment, the grinding element is dimensioned to be installed side by side with one or more further grinding elements in a radial plane within the grinding shell to form a grinding element assembly with a cross-section of a hollow cylinder.

In an embodiment, the grinding element has an axial length that is smaller than the axial length of the cylindrical grinding shell, preferably an axial length that is smaller than the axial length of the grinding shell.

In an embodiment, the grinding element is dimensioned to be stacked up with one or more further grinding elements in the axial direction within the cylindrical grinding shell to form a grinding element assembly having a desired total axial length.

In an embodiment, the central stirring shaft is provided with axially spaced stirring elements, preferably grinding discs, along the central stirring shaft, and at least one counter disc is arranged to project radially inward from the axial support structure at an axial location which is offset from axial locations of stirring elements of the stirring shaft.

In an embodiment, the axial support structure comprises an axial sidewall defining an outer peripheral surface of the grinding element, and wherein the at least one counter disc is arranged to project radially inward from an inner surface of the axial side wall.

In an embodiment, the axial support structure further comprises a plurality of spaced wear-protective elements provided along an inner surface of the axial sidewall of the support structure and protruding inwardly from said inner surface a plurality of wear protective elements provided on the inner surface of the axial sidewall to protrude radially inwards from the inner surface of the sidewall.

In an embodiment, at least part of the protective elements comprises elongated protective elements extending parallel or almost parallel with along the inner surface of the axial sidewall of the axial support structure.

In an embodiment, at least part of the elongated protective elements comprise two or more protective element segments cascaded in line or in other pattern.

In an embodiment, the axial profile and/or side profile of the protective elements comprises at least one or more of a block-shaped element, a vane, and a fin.

In an embodiment, the plurality of the protective elements is arranged to form a skeleton for lining with a dissimilar material, which lining is arranged to be sacrificed during the grinding operation in order to expose the protective elements.

In an embodiment, the grinding element has a cage-like structure in which the axial support structure comprises a plurality of elongated spaced support members defining the outer periphery of the grinding element, and the at least one counter disc is connected to and arranged to project radially inward from the plurality of elongated spaced support members of the axial support structure.

In an embodiment, at least part of the plurality of elongated spaced support members is arranged to extend parallel or almost parallel with the axial direction, and/or inclined relative to the axial direction and/or non-linearly relative to the axial direction.

In an embodiment, at least part of the plurality of elongated spaced support members comprise curved support beams.

In an embodiment, the plurality of elongated spaced support members is arranged to form a skeleton for lining with a dissimilar material, which lining is arranged to be sacrificed during the grinding operation in order to expose the elongated spaced support members.

In an embodiment, the at least one counter disc comprises castellation on one side of the counter disc.

In an embodiment, the at least one counter disc comprises on both sides of the counter disc.

In an embodiment, the at least one counter disc comprises castellation on an inner radial edge of the counter disc.

In an embodiment, the castellation comprises spaced members at intervals of 10-60 degrees in a tangential direction, preferably at intervals of 10-45 degrees, more preferably at intervals of 10-30 degrees, even more preferably at intervals of 10-20 degrees.

In an embodiment, a height of the castellation in the axial direction is in a range from 0.5 to 3 times an axial thickness of the counter disc, preferably about the same as the thickness of the counter disc.

In an embodiment, a height of the castellation is within range of 2 mm to 200 mm, preferably within range of 5 mm to 150 mm, more preferably within 10 mm to 100 mm.

In an embodiment, a ratio of a height of the castellation to the spacing of the castellation is within range of ½ to 1/20, preferably within range of ⅕ to 1/20, more preferably within range of ⅛ to 1/12.

In an embodiment, a width of the castellation in a tangential direction is from 1 mm to about a thickness of the counter disc, preferably from 5 mm to about the thickness of the counter disc, more preferably about the thickness of the counter disc.

In an embodiment, a total width of all castellation in a tangential direction is less than 0.25 to 0.35 times a tangential length of the grinding element.

In an embodiment, an orientation of the castellation is within range of 0 degrees to 90 degrees, preferably within range of 0 degrees to 25 degrees, more preferably within 0 degrees to 10 degrees of inclination relative to the radial direction of the counter disc.

In an embodiment, the castellation extends across the counter disc from the axial support structure to a radially inner edge of the counter disc.

In an embodiment, the castellation extends across a portion of the counter disc between the axial support structure to a radially inner edge of the counter disc, preferably across the inner portion of counter disc close to the inner edge of the counter disc.

In an embodiment, the castellation extends beyond a radially inner edge of counter disc, preferably around the inner edge to join to a castellation on the opposite side of the counter disc.

In an embodiment, the castellation is only on a radially inner edge of the counter disc.

In an embodiment, the grinding element is a stand-alone element adapted for a loose fit mounting within a grinding shell.

In an embodiment, the grinding element is connectable to one or more further grinding elements to form a larger stand-alone grinding element assembly adapted for a loose fit mounting within a grinding shell.

In an embodiment, the grinding element is configured to be used with a grinding media having diameter selectable from a range of approximately 0.5-20 mm depending on a F80 of the particulate material and a P80 of the ground particulate material in each specific grinding application.

In an embodiment, the grinding element is a refurbished grinding element.

Another aspect of the invention is a grinding element assembly comprising grinding elements according to any one of embodiments above.

A further aspect of the invention is a stirred bead grinding mill comprising a substantially cylindrical grinding shell and a central stirring shaft within the grinding shell, and at least one grinding element of any one of embodiments above.

In an embodiment, the central stirring shaft is provided with axially spaced stirring elements, preferably grinding discs, along the central stirring shaft.

In an embodiment, the stirred bead grinding mill comprises a vertical or horizontal disc mill.

Still another aspect of the invention is use of the grinding element of any one of embodiments above in mineral ore grinding.

Another aspect of the invention is use of the grinding element of any one of embodiments above with a grinding media having diameter selectable from a range of approximately 0.5-20 mm depending on a F80 of the particulate material and a P80 of the ground particulate material in each specific grinding application.

A further aspect of the invention is a method of refurbishing the grinding element of any one of embodiments above, comprising removing the grinding element from a stirred bead grinding mill, and replacing or rebuilding a worn castellation of the grinding element.

In an embodiment, the rebuilding comprises building the castellation back up to replace worn material.

In an embodiment, the rebuilding comprises building the castellation back up to replace worn material using one or more of following techniques: depositive welding, 3D printing, addition of rubber or polymer to the worn areas.

In an embodiment, the replacing comprises attaching new castellation to the grinding element by one or more of bolting, riveting, welding, gluing, and cementing.

BRIEF DESCRIPTION OF THE DRAWINGS

In the following the invention will be described in greater detail by means of exemplary embodiments with reference to the attached drawings, in which.

EXEMPLARY EMBODIMENTS OF THE INVENTION

Figure 1:
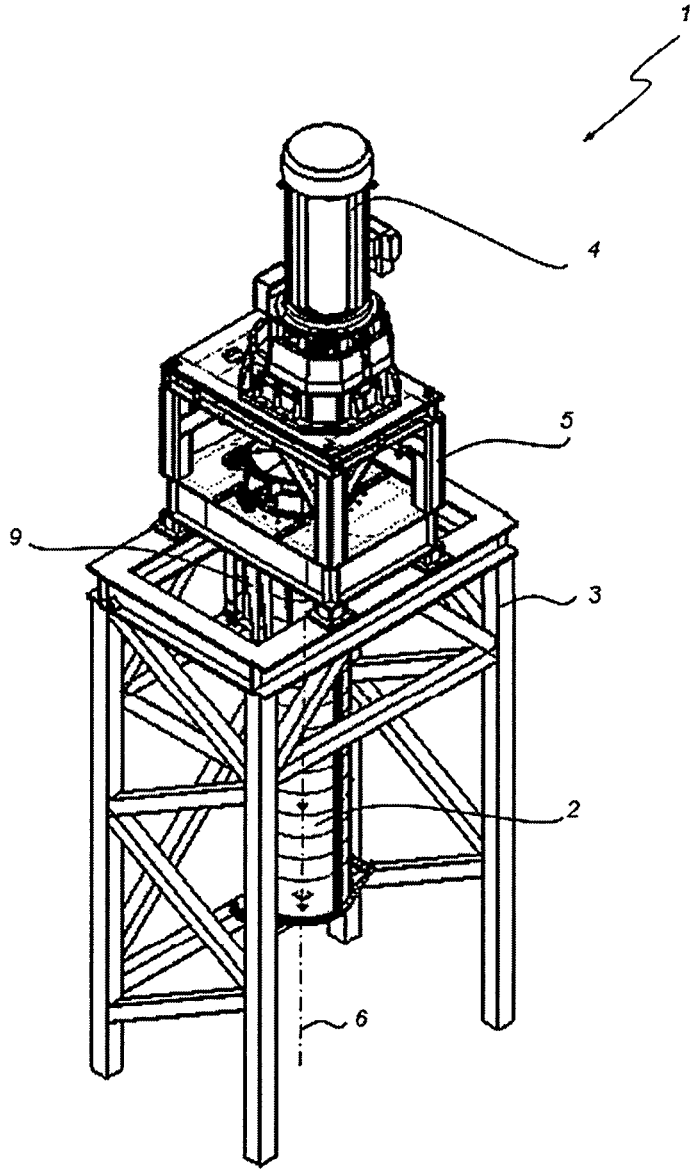
FIG. 1 is a perspective view of an exemplary grinding mill suitable for comprising grinding elements according to an embodiment of the invention.
Figure 2:
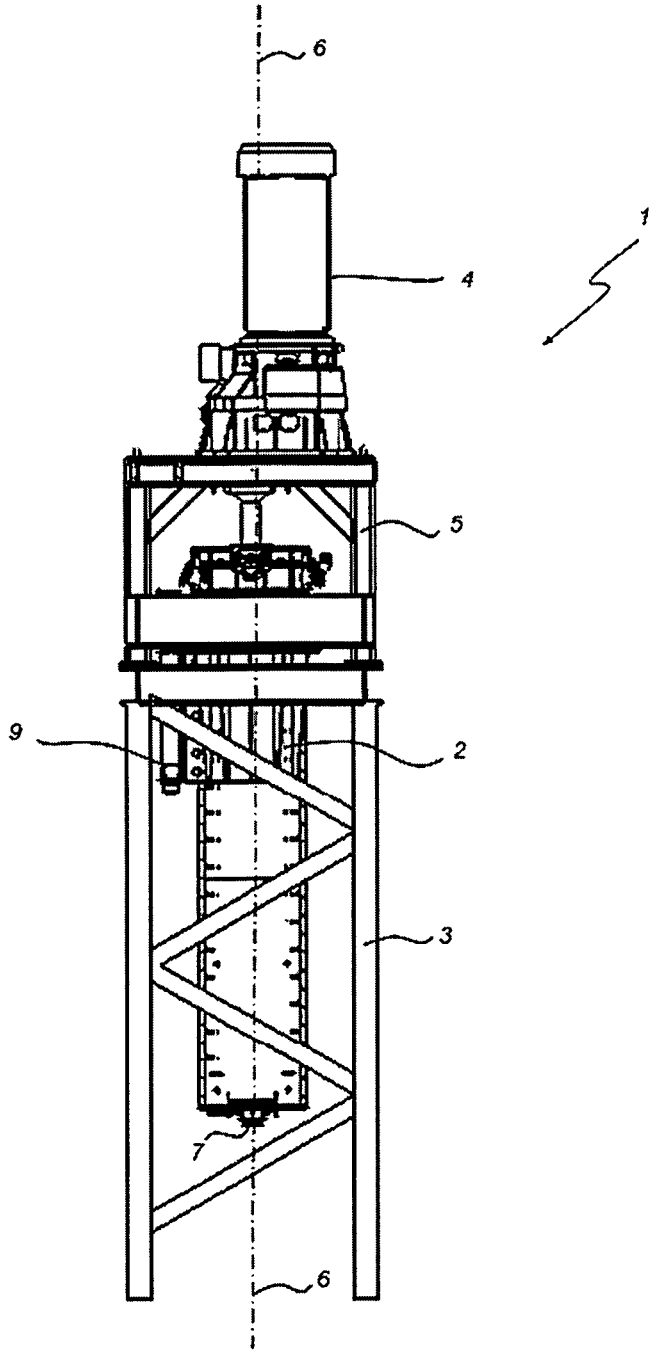
FIG. 2 is a side view of the grinding mill of FIG. 1.
Figure 3:
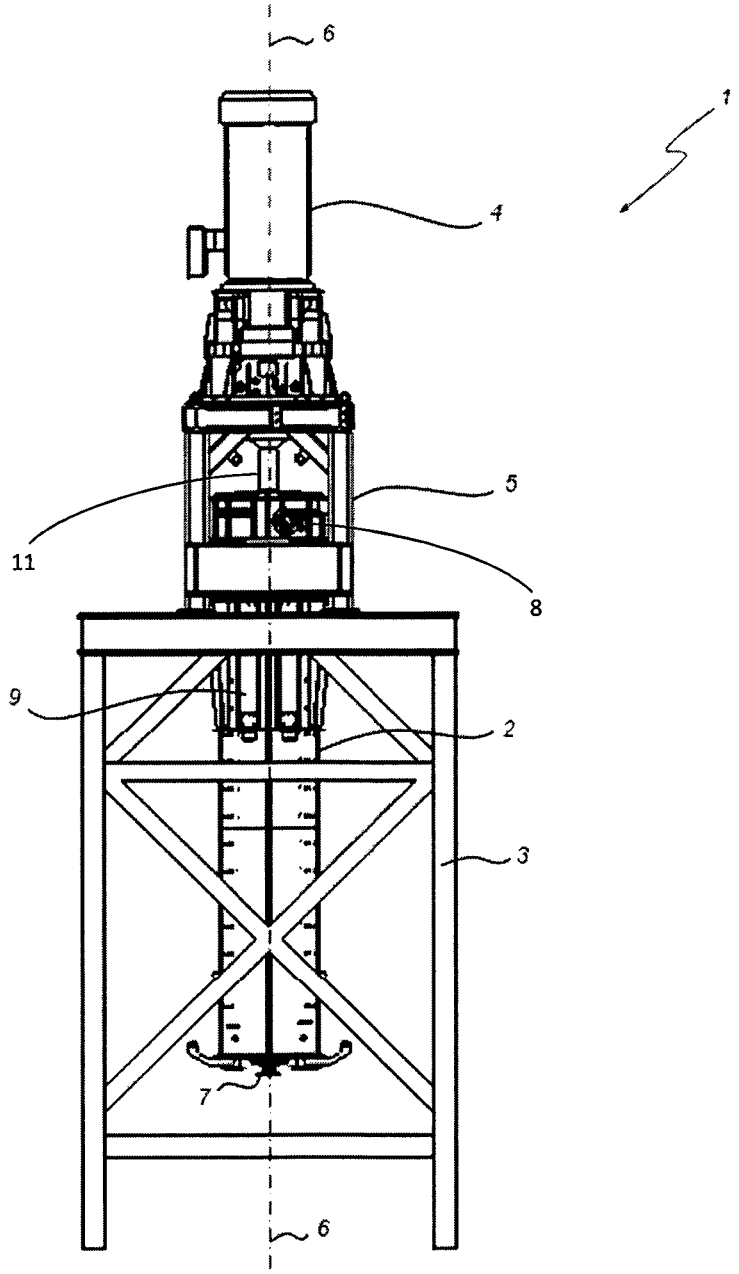
FIG. 3 is a front view of the grinding mill of FIG. 1.

The present invention will now be described with reference to the following examples which should be considered in all respects as illustrative and nonrestrictive.

It will also be appreciated that embodiments of the invention are readily applicable to various types of mineral ore having a variety of particle sizes and particle size distributions. Particle size of the feed and discharge are typically measured. Hence, the particle size of the slurry (e.g. the particulate material and a slurrying liquid) at the feed inlet is typically described by its F80, meaning that 80% of the feed particles (by mass) pass through a nominated screen mesh size. For example, an F80=1000 μm means that 80% of the total mass of particles present will pass through a 1000 μm screen aperture. An alternative size description is F100, meaning that 100% of the feed particles pass through a nominated screen mesh size. Similarly, it will be understood by one skilled in the art that P80 means that 80% of the mass of discharged particles pass through a nominated screen mesh size. For example, a P80=60 μm means that 80% of the mass of particles present in the discharge will pass through a 60 μm screen aperture. Embodiments of the invention have been primarily developed to process particle sizes in the range of F80=30 μm to F80=4000 μm, especially in the range of F80=80 μm to F80=1000 μm for the incoming particulate material and particles sizes in the range of P80=0.1 μm to P80=800 μm, especially in the range of P80=1 μm to P80=400 μm for the ground discharged product. Hence, embodiments of the present invention permit the grinding mill 1 to process a wide range of particle sizes for mineral particles having a wider particle size distribution in the above stated F80 and P80 ranges to produce very fine particle sizes down to P80=1 μm. Thus, embodiments of the invention are readily applicable to many different types of particulate materials and are not limited to particular mineral ore types, but can include iron, quartz, copper, nickel, zinc, lead, gold, silver and platinum. Other particulate materials that can be processed using embodiments of the invention include concrete, cement, recyclable materials (such as glass, ceramics, electronics and metals), food, paint pigment, abrasives and pharmaceutical substances. In these other applications, embodiments of the invention are used to reduce the size of the particulate material using a grinding process.

It will also be appreciated that embodiments of the invention are readily applicable to various types of stirred bead grinding mills having a stationary grinding shell and a central stirring shaft with axially spaced stirring elements, preferably grinding discs, provided along the shaft. Examples of suitable stirred grinding mills are described in the applicant's co-pending PCT patent application PCT/FI2016/050545 which is incorporated by reference herein. In the following, examples of a structure and operation of suitable stirred grinding mills, particularly disc mills, are illustrated in order to make it easier to comprehend embodiments of the invention, while the intention is not to restrict the application of the invention to these exemplary grinding mills.

In the Figures, corresponding features within the same embodiment or common to different embodiments have been given the same reference numerals. Referring to FIGS. 1 to 5, a stirred bead grinding mill 1 for grinding a slurry having particulate material may comprise a mill body 2 and a drive mechanism 4 for providing a stirring action in the mill body 2 by rotating the drive shaft 11 of the mill body 2 about a longitudinal axis 6. The mill body 2 and the drive mechanism 4 may be mounted on a frame structure, such as on a base frame 3 and a drive frame 5, respectively, in the illustrated exemplary embodiments. In the illustrated example the mill body 2 may comprise a mounting assembly 9 for fitting the mill body to the base frame 3 and operatively aligning the mill body to the drive mechanism 4. In embodiments, the grinding mill may be a fine grinding mill, and is called a high intensity grinding mill, in which the rotating action results in intense grinding of the slurry particles by the grinding media. Grinding mills may have a relatively high power consumption in order to achieve fine grinding, e.g. in the range from 5 kWhr/t to 100 kWhr/t (kilowatt hours per tonne). The power intensity, $kW/m^3$, of the grinding mills may also be relatively high, e.g. up to 100-300 $kW/m^3$, or more.

A charge of feed slurry comprising mineral ore particles may be fed into the mill body 2 through the bottom inlet 7 that is shown as a centred inlet in this example. The mill body 2 may be partially filled (e.g. about ⅔ filled) with grinding media, such as small beads. Grinding media may also be added into the mill body 2 initially through the outlet 8, or via a separate entry into the top of the mill, before the feed slurry (e.g. the particulate material and a slurrying liquid) is added and the grinding mill 1 is put into operation. In operation, the mill body 2 or a stirring mechanism 10 inside the mill body 2 is rotated by the drive mechanism 4 about the axis 6 to rotate or stir the feed slurry and grinding media together, thereby providing relative motion of the slurry of grinding media and particulate material at a desired speed within the grinding chamber and causing the feed slurry particles to be crushed or ground against and between the grinding media, whereby comminution takes place by attrition between the grinding media. The tip speed of the stirring mechanism may be from the range of 4-12 m/s, for example. The ground product may then be discharged through the top outlet 8. The grinding media may typically comprise ceramic or steel beads that range from 0.5 mm to 20 mm in diameter. The size of the grinding media may vary in other embodiments, depending on requirements. For example, the diameter of the grinding media can be 30 or 50 times the diameter of the slurry particles, which can be measured by reference to F80 or F100. For example, the grinding media diameter may be selected from a range of approximately 0.5-20 mm depending on a F80 of the particulate material and the P80 of the ground particulate material in each specific grinding application, preferably from a range of 0.5-1.5 mm for F80 of 70 μm or less and for P80 of 20 μm or less, preferably from a range of 1-3 mm for F80 of 50-100 μm and for P80 of 20-60 μm, preferably from a range of 3-6 mm for F80 of 100-300 μm and for P80 of 50-100 μm and preferably from a range of 6-20 mm for F80 of 300-4000 μm and for P80 of 80-300 μm.

Figure 4:
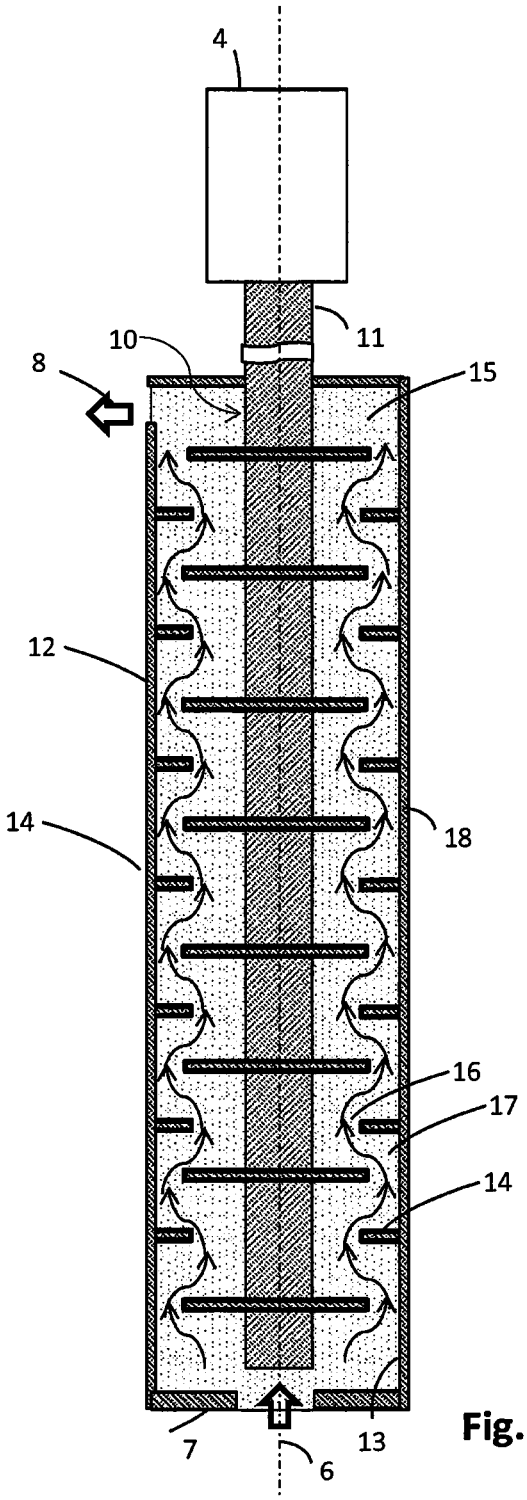
FIG. 4 is a cross-sectional side view of a portion of an exemplary mill body used in the grinding mill of FIG. 1.

Referring to FIG. 4, in the illustrated exemplary embodiments, the shell 18 is arranged vertically in the grinding mill and has a bottom inlet 7 and a top outlet 8. It will be appreciated that in other embodiments, the mill body 2 may be arranged to be inclined or at an angle in the grinding mill 1. In some embodiments, the shell 18 may be arranged to lie horizontally in the grinding mill. Likewise, in other embodiments, the inlet 7 and outlet 8 can be placed at locations of the shell other than the bottom and top, respectively.

Referring to FIG. 4, an exemplary embodiment is illustrated wherein the mill body 2 may comprise a generally cylindrical drum or shell 18 that defines an internal cavity or grinding chamber 15, and a rotating stirring device assembly 10 positioned within the shell 18. The term "cylindrical" as used herein shall be understood to refer generally to any cylinder-like structure with circular or round cross-section. Although in the illustrated exemplary embodiments the mill body may have generally cylindrical shape, it will be appreciated that the mill body or the shell 18 can take other cross-sectional shapes in other embodiments, such as rectangular, square, oval or oval-like, or any other regular or irregular polygonal shape, such as the hexagonal, defining the grinding chamber 15. The stirring device assembly may comprise a one or more drive shafts 11 to each of which may be mounted a plurality of stirring devices 12 described in more detail below. The one or more drive shafts may be coaxial with the mill body 2 (e.g. as illustrated in the exemplary embodiments), or not. The one or more drives shafts may be parallel to a longitudinal axis 6 of the mill body 2, as illustrated in the exemplary embodiments, or the drive shaft may be inclined or at an angle to the axis of the mill body. The stirring devices 12 may be coaxial with the axis of the drive shaft, as illustrated in the exemplary embodiments, or they may be non-coaxial. In the exemplary embodiments, the stirring effect is caused by the rotating stirring devices 12 mounted on the shaft 11. The stirring device assembly 10 takes the form of an impeller or a rotor but is also known as a drive shaft assembly. As such, the stirring device assembly will hereinafter be referred to as a mill rotor in reference to this embodiment.

Figure 5A:
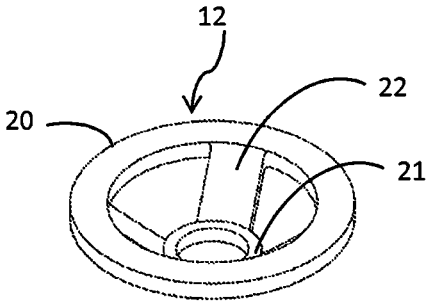
FIG. 5A is a perspective view of an exemplary flat grinding disc.

In embodiments, the stirring devices 12 in the mill rotor 10 may comprise a plurality of coaxial or non-coaxial grinding discs 12 spaced up the length of the drive shaft 11. An example of a grinding disc 12 is illustrated in FIG. 5A. In the exemplary embodiment, a grinding disc 12 may comprise a flat disc body 20 that may be connected via arms 22 (typically known as spokes) to a mounting ring 21 for mounting the grinding disc 12 to the drive shaft 11 of the stirring device assembly 10. Although in the exemplary embodiment the stirring device is an annular disc, but it will be appreciated that the stirring device can take other planar forms in other embodiments, such as rectangular, square, oval or oval-like, circular and any other regular or irregular polygonal shape. It will be appreciated by one skilled in the art that for industrial duties the annular disc size may range from 400 mm diameter to 2500 mm diameter. However, the invention applies equally to fine grinding discs of any size. Also, the stirring devices 12 can have surfaces other than two opposed surfaces, such as any number of surfaces that have the same or different shapes. For example, the stirring devices may have an inclined or angled surface, a curved surface, a corrugated surface, a saw-toothed surface, irregular surface or any other regular or irregular shape. In embodiments, grinding disc may have through holes, openings, interruptions or cut outs. For ease of reference, the stirring devices 12 in this embodiment will hereinafter be referred to as grinding discs. However, embodiments of the invention are not limited to any specific structure or design of a stirring device assembly or stirring devices. For example, a stirring assembly may alternatively comprise radial posts spaced up along a drive shaft. As a further example, a stirring assembly may comprise a screw auger.

Figure 5B:
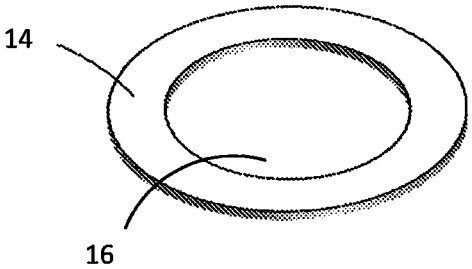
FIG. 5B is a perspective view of an exemplary counter disc.

There may also be a plurality of stationary planar annular shelves or counter discs 14 on an internal side wall 13 of the mill shell 18 positioned in between each rotational stirring device or grinding disc 12. An example of a counter disc 14 is illustrated in FIG. 5B. The planar annular shelves or counter discs 14 may extend or protrude into the chamber 15 between the stirring devices or grinding disc 12. The shelves 14 tend to subdivide the internal chamber 15 into individual subchambers 17 interconnected through openings 16 defined between the shelves 14 and the drive shaft 11. Depending on the application, there can be any number of sets of stirring devices 12 and shelves 14, such as the rotating and stationary discs. For example, there may be up to several dozens of sets, but typically 5-20.

In operation, the drive mechanism 4 rotates the drive shaft 11 of the stirring device assembly 10, rotating the grinding discs 12 that in turn provide rotational motion of the slurry of the grinding media and the particulate material (as illustrated by the transverse arrows in the Figures) at a desired speed within the grinding chamber 15 of the mill body 2. The rotational motion causes the feed slurry particles to be ground against and between the harder grinding media, thus releasing valuable mineral particles and reducing them in size for further downstream processing after being discharged through the outlet 8. The slurry flow transfers upwardly through the opening 16 to the subchamber 17, passes through the rotating disc 12, then through the next opening 16 to the next subchamber 17. The free space in each subchamber 17 around the rotational grinding disc 12 can be regarded as a classification stage where coarser particles move towards the internal wall of the shell 18 while finer particles move faster upwards through the openings 16. Due to the vertical arrangement of the mill, classification is conducted simultaneously throughout the grinding process with larger particles remaining longer at the peripheral, while smaller particles move upwards.

In other words, in the exemplary vertical stirred bead mill the feed slurry is fed from below, with the ore particles being progressively ground smaller by the moving grinding media beads before exiting from the top of the grinding mill. The grinding media beads are significantly larger (e.g. tens of times larger) than the ore particles, which is necessary for grinding, and also keeps the grinding media beads inside the grinding mill due to their ability to settle faster than the upward flow rate of the feed slurry. The mill may be, however, sized such that the grinding media beads are partially fluidised by the upward flowing feed slurry. The electric power draw to drive the shaft is sensitive to the feed flow rate, i.e. at higher flow rates the grinding media beads are lifted slightly and exert less resistance on the grinding discs. In a horizontal stirred bead mill, a centrifugal separator may be provided at the end of the mill to keep the beads and coarser particles in the mill.

In stirred media mills, the shear forces are significant. Ideally the grinding mill would not wear, but in practice liner and disc wear are inevitable even in well designed and built equipment. Accelerated wear of the components of the grinding mill makes their operational life very short, thus requiring more frequent replacement than desired. The frequent replacement of the grinding mill components also increases the amount of downtime, reducing the efficiency of the grinding mill, as well as increasing maintenance costs.

Uneven wear of the grinding discs has been observed in stirred grinding mills, with the wear occurring faster for the lower grinding discs (at the feed end) than for the upper grinding discs (at the discharge end). Preferably the grinding discs would last a number of months, and wear more evenly so that they would be due for replacement at the same time. One cause of the uneven wear may be that the grinding media beads are only partially fluidized, meaning that only a portion of their weight is carried by the upward flow of feed slurry. The remainder of the gravitational force is born downwards through the packed bed of grinding media beads such that the gravitational force is highest at the bottom of the grinding mill. This increases the force on the mill shell, and also the grinding discs, which are then subject to a higher wear rate towards the bottom of the grinding mill. Another cause of the uneven wear may be that the coarse feed particles are introduced into the bottom of the grinding mill, which is likely to also increase the wear rate at the base of the grinding mill. Similar uneven wear occurs also in horizontal stirred grinding mills which also wear faster at the feed end.

Figure 6:
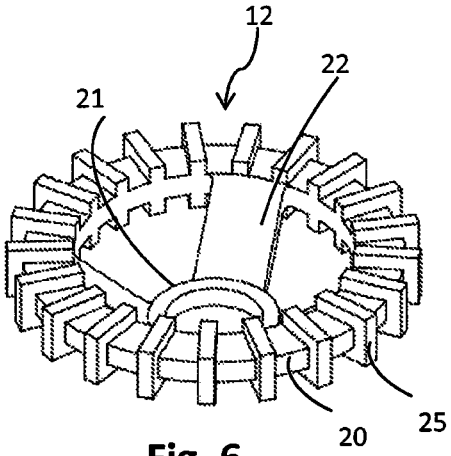
FIG. 6 is a perspective view of an exemplary castellated grinding disc.

In the applicant's co-pending PCT patent application PCT/FI2016/050545, which is incorporated by reference herein, embodiments are proposed in which a protective castellation may be provided on the stirring devices or grinding disc 12 to capture and form a media layer against the rotating disc to minimize differential speed between and media and disc, thereby reducing wear. An exemplary embodiment of a grinding disc 12 provided with a castellation 25 is illustrated in FIG. 6. In the exemplary embodiment, the castellation may comprise protective elements 25 that may be provided adjacent to the outer edge of the disc body 20 to extend outwardly from the disc body 20. In an exemplary embodiment, a mounting hub 21 may be connected via arms 22 (typically known as spokes) to the disc body 20 for mounting each grinding disc 12 to the drive shaft 11 of the stirring device assembly 11. The protective elements 25 in this embodiment take the form of blocks or block-like elements that may be integrally formed with the disc body 20 and arranged so that opposed sides and one end of the blocks may project outwardly from the planar surfaces and outer edge of the disc body 20. Each block 25 may thus extend both substantially orthogonally relative to the opposed planar surfaces via its opposed sides and radially outwardly from the outer edge via its end. Alternatively, the protective elements 25 may be in the form of U-shaped blocks mounted to the disc body 20 so that opposed sides and one end of each block 25 extends or projects outwardly from the planar surfaces and outer edge of the disc body, respectively. It will be appreciated that the protective elements 25 can take any number of forms in order to create the zone around each grinding disc 12. Examples of other forms or shapes of the protective elements are disclosed in the applicant's co-pending PCT patent application PCT/FI2016/050545, which is incorporated by reference herein.

Figure 7:
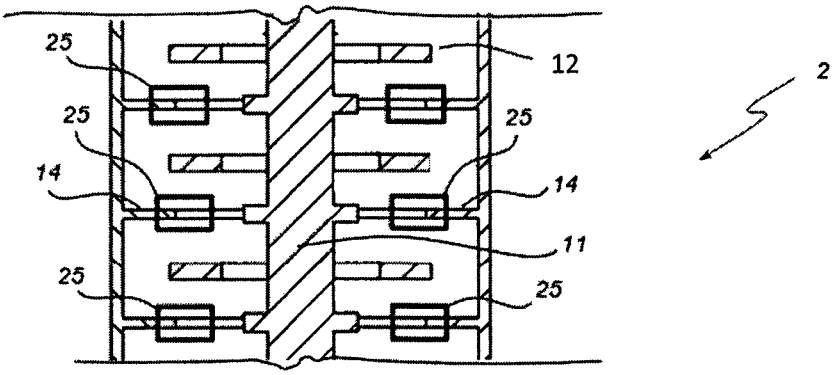
FIG. 7 is an elevation view of an exemplary castellated grinding element on a counter disc.

In the applicant's co-pending PCT patent application PCT/FI2016/050545, which is incorporated by reference herein, embodiments are proposed in which a protective castellation 25 may be provided on the shelves 14 to further minimise wear of the shelves and the inner sidewalls, as illustrated in FIG. 7.

In spite of these improvements, there is still need for reducing wear of the components of the grinding mills, reducing the time and work required for replacement of components, reducing the downtime, and/or reducing maintenance costs.

According to an aspect of the invention, a novel grinding element for a stirred grinding mill is provided. The grinding element comprises an axial support structure arranged to form the outer periphery of the grinding element adapted to fit within a grinding shell. The grinding element further comprises at least one counter disc arranged to project radially inward from the axial support structure to an extent separating two grinding zones in an axial direction of the grinding shell while allowing the central stirring shaft to be provided within the grinding shell. At least part of the counter disc and/or the support structure is provided with castellation.

In embodiments, the grinding element may have a cross-section of any arc segment of a hollow cylinder, preferably a cross-section of an arc segment in a range from 20 degrees to 180 degrees of a hollow cylinder, more preferably a cross-section of a hollow half-cylinder.

Figure 8:
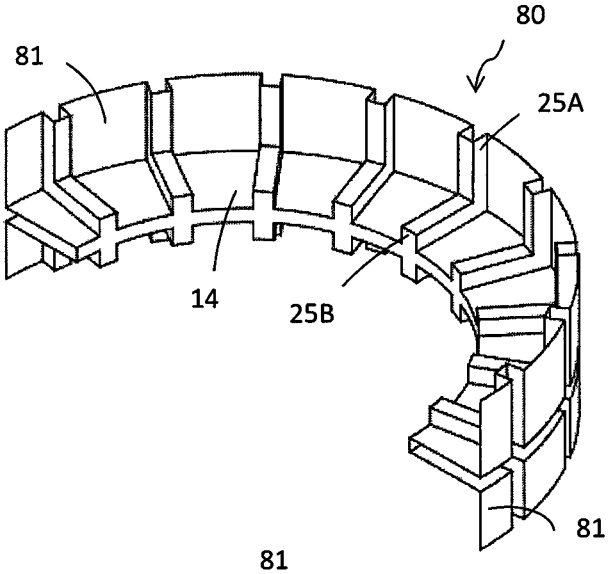
FIG. 8 is a perspective view of an exemplary castellated grinding element having a cross-section of a hollow half-cylinder.

An exemplary grinding element 80 having a cross-section of a hollow half-cylinder is illustrated in FIG. 8. In the illustrated example, the grinding element 80 comprises an axial support structure in form of an axial sidewall 81 defining an outer peripheral surface of the grinding element 80. The outer peripheral surface of the grinding element 80 may be arranged to tightly or loosely fit against the inner surface of the shell to form a replaceable protective subshell or a liner which prevents the actual shell 18 from wearing. The grinding element 80 further comprises an annular counter disc 14 arranged to project radially inward from an inner surface of the axial side wall 81. In embodiments the counter disc 14 is arranged to project radially inward from the axial support structure at an axial location which is offset from axial locations of the grinding discs 12 of the stirring shaft within the grinding shell 18.

Figure 9A:
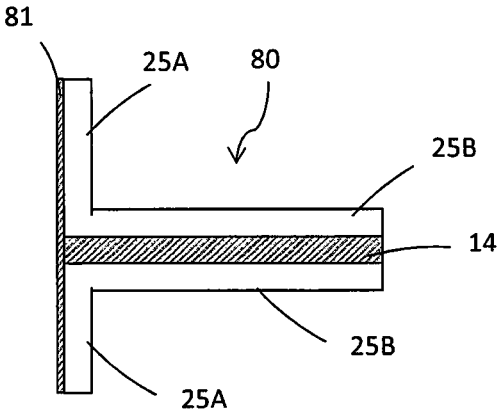
FIGS. 9A-9H show cross-sectional side views of different exemplary grinding elements.

In the exemplary grinding element 80 shown in FIG. 8, both the axial sidewall 81 and the counter disc 14 are provided with castellation 25A and 25A, respectively. A cross-sectional side view of the grinding element 81 is illustrated in FIG. 9A. The castellation 25A and 25B reduces wear of the sidewall 80 and the counter disc 14, thereby prolonging the lifetime of the grinding element 80. Further Examples of grinding elements 80 having castellation 25A and 25B on both the axial sidewall 81 and on the counter disc 14 are illustrated in FIGS. 9A, 9C, and 9D.

Figure 9B:
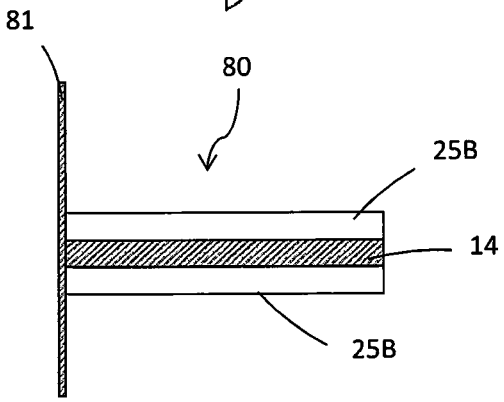
Figure 9C:
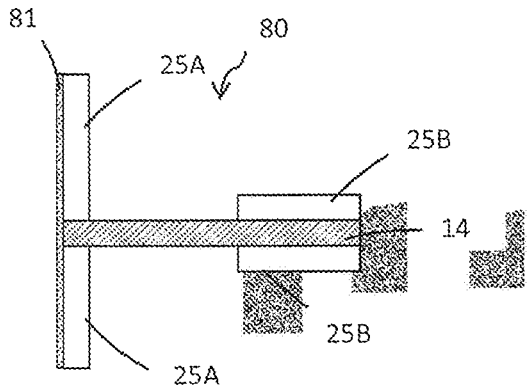
Figure 9F:
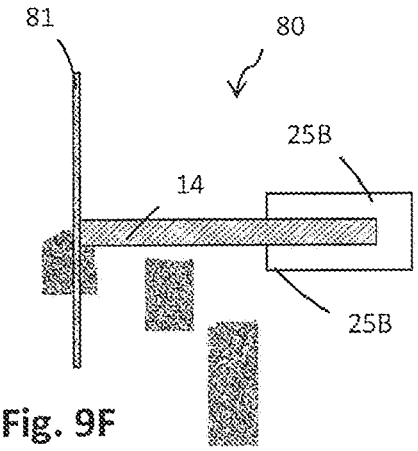
Figure 9D:
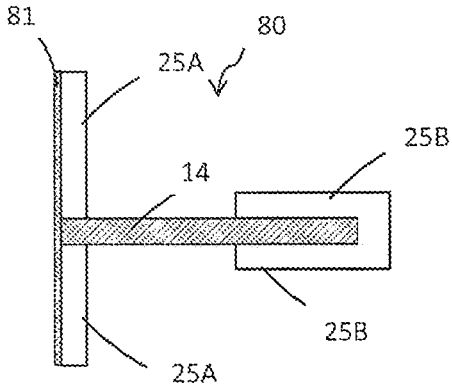
Figure 9G:
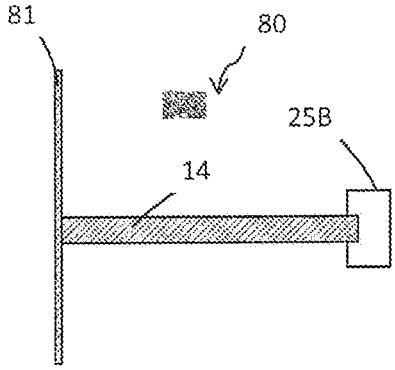
Figure 9E:
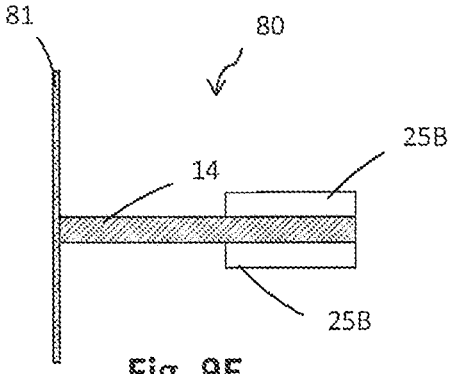
Figure 9H:
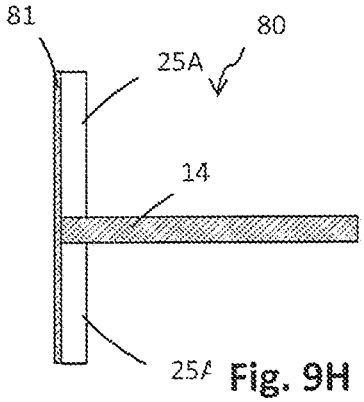

In embodiments there may be castellation 25A on the sidewall 81 only, as illustrate by an example in FIG. 9H.

In further embodiments there may be castellation 25B on the counter disc 14 only, as illustrate by examples in FIGS. 9B, 9E, 9F, and 9G.

The castellation of the axial sidewall 81 may comprise a plurality of spaced wear-protective elements 25A provided on the inner surface of the axial sidewall 81 to protrude radially inwards from the inner surface of the sidewall 81. The protective elements 25A may be elongated protective elements extending parallel with the axis of the grinding element.

The counter disc 14 may comprise castellation on one or both sides of the counter disc 14, as illustrated by examples in FIGS. 8, 9A, 9B, 9C, 9E, 9F, and 9G. In some embodiments there may be castellation 25B on one or both sides of the counter disc 14 but not on the inner radial edge of the counter disc 14, as illustrated by examples in FIGS. 8, 9A, 9B, 9C, and 9E. In some embodiments there may be castellation 25B on one or both sides of the counter disc 14 and also on the inner radial edge of the counter disc 14, as illustrated by examples in FIGS. 9D, 9F, and 9G.

In embodiments, the shelves or counter discs 14 may have holes, interruptions or cut outs in order to enhance sludge circulation.

In embodiments the castellation 25B may extend across the radial width of the counter disc 14 from the inner sidewall 81 to a radially inner edge of the counter disc 14, as illustrated in FIGS. 9A and 9B.

In some embodiments the castellation 25B may extend on one side or both sides of the counter disc 14 on a portion of the radial width of the counter disc, as illustrated in FIGS. 9C, 9D, 9F, and 9G, preferably across the inner portion of counter disc 14 close to the inner edge of the counter disc. In some embodiments there may be castellation 25B on the inner radial edge of the counter disc 14 or at the tip of the counter disc as illustrated in FIG. 9D. In some embodiments, the castellation 25B may extend beyond a radially inner edge of counter disc 14, preferably around the inner edge to join to a castellation 25B on the opposite side of the counter disc 14.

Figure 10A:
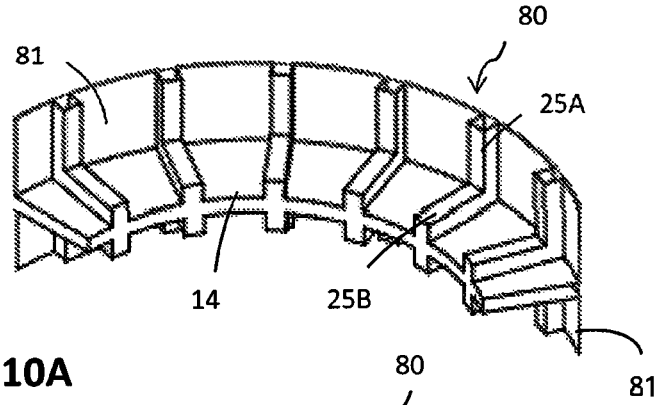
FIGS. 10A-10C show perspective views of exemplary castellated grinding elements having different types of cross-sections.

An exemplary grinding element 80 having a cross-section of a hollow ⅓-cylinder (a 120 degrees segment of a cylinder) is illustrated in FIG. 10A.

Figure 10B:
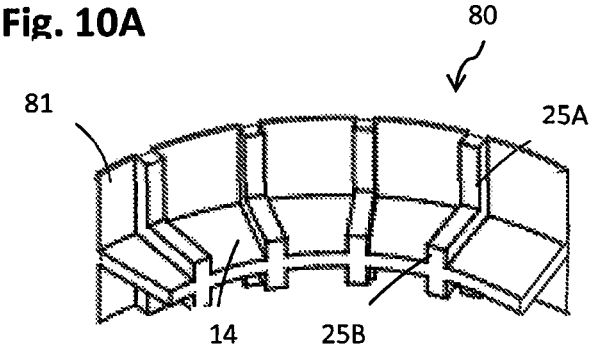

An exemplary grinding element 80 having a cross-section of a hollow ¼-cylinder (a 90 degrees segment of a cylinder) is illustrated in FIG. 10B.

Figure 10C:
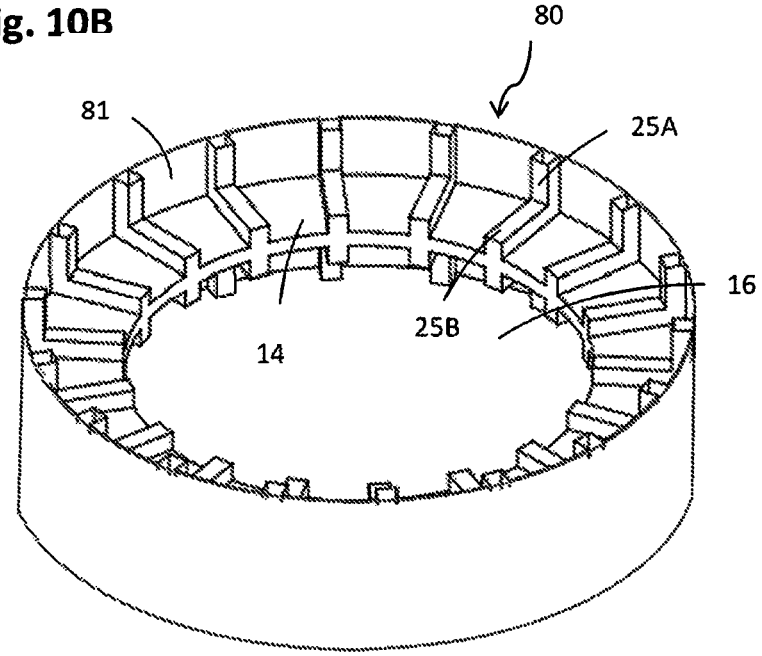

An exemplary grinding element 80 having a cross-section of a hollow full-cylinder (360 degrees) is illustrated in FIG. 10C. In this case a radius of the central opening 16 of the grinding element 80 must be larger than an outer radius of a grinding disc 12 in order to allow a stirring shaft 11 and grinding discs 12 pass through the opening 16 during installation.

In embodiments in which the grinding element may have a cross-section of an arc segment of a hollow cylinder, a grinding element 80 is dimensioned to be installed side by side with one or more further grinding elements 80 in a radial plane within the grinding shell 18 to form a grinding element assembly with a cross-section of a hollow cylinder. For example, a pair of grinding elements 80 having a cross-section of a half-cylinder (180 degree segment) may be installed side by side to obtain a full hollow cylinder, similar to that illustrated in FIG. 10C. Similarly three grinding elements of 120 degrees, or four grinding elements of 90 degrees may side by side to form a grinding element assembly with a cross-section of a hollow cylinder. In embodiments, the grinding element 80 may comprise means for connection to one or more further grinding elements. For example, such connection means may include one or more of a clamp, a flange, a bolt connection. In embodiments, the grinding element 80 may be a stand-alone element adapted for a loose fit mounting within a grinding shell 18.

In embodiments, a grinding element 80 has an axial length that is approximately equal to or a multiple of the distance between the axially spaced grinding discs 12 of the central stirring shaft 11. Generally, the grinding element has an axial length that is smaller than the axial length of the cylindrical grinding shell.

Figure 11A:
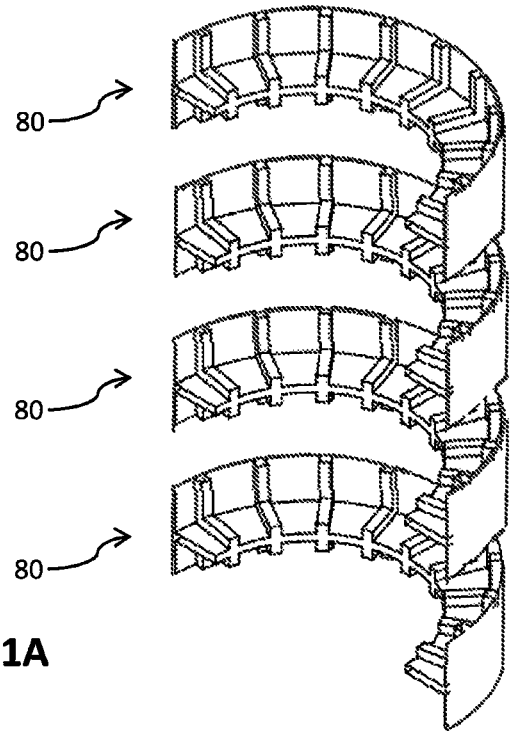
FIGS. 11A-11B show perspective views illustrating stacking of exemplary castellated grinding elements.
Figure 11B:
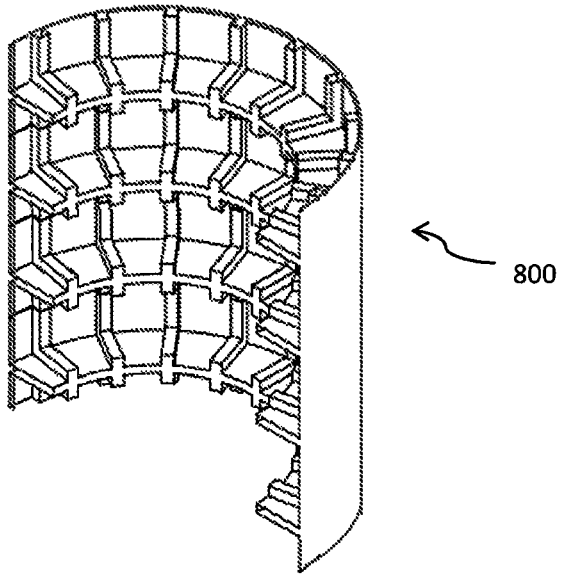

In embodiments, the grinding element 80 is dimensioned to be stacked up with one or more further grinding elements 80 in the axial direction within the cylindrical grinding shell 18 to form a grinding element assembly 800 having a desired total axial length. In an example illustrated in FIGS. 11A and 11B, four half-cylinder grinding elements 80 are stacked on top of each other to form a longer grinding element assembly 800. Similarly, the exemplary grinding elements 80 shown in FIGS. 10A, 10A, and 10C, or other type of grinding elements, can be stacked.

In embodiments, a grinding element assembly 800 may be assembled or manufactured prior to installing the grinding element assembly within the shell 18 of the grinding mill. In embodiments, two or more grinding element assemblies 800 may be first formed, and the grinding element assemblies 800 may then be installed and stacked with a grinding shell 18 of the grinding mill.

In embodiments, a single grinding element 80 may comprise two or more counter discs 14 in the axial direction. Such a single grinding element having multiple counter discs may be manufactured in various alternative ways, such as welding or casting. For example, a single grinding element 80 having four counter discs 14 in the axial direction may be similar to the grinding element assembly 800 shown in FIG. 11B.

In embodiments, the grinding element assembly 800 is a stand-alone element adapted for a loose fit mounting within a grinding shell 18.

Figure 12A:
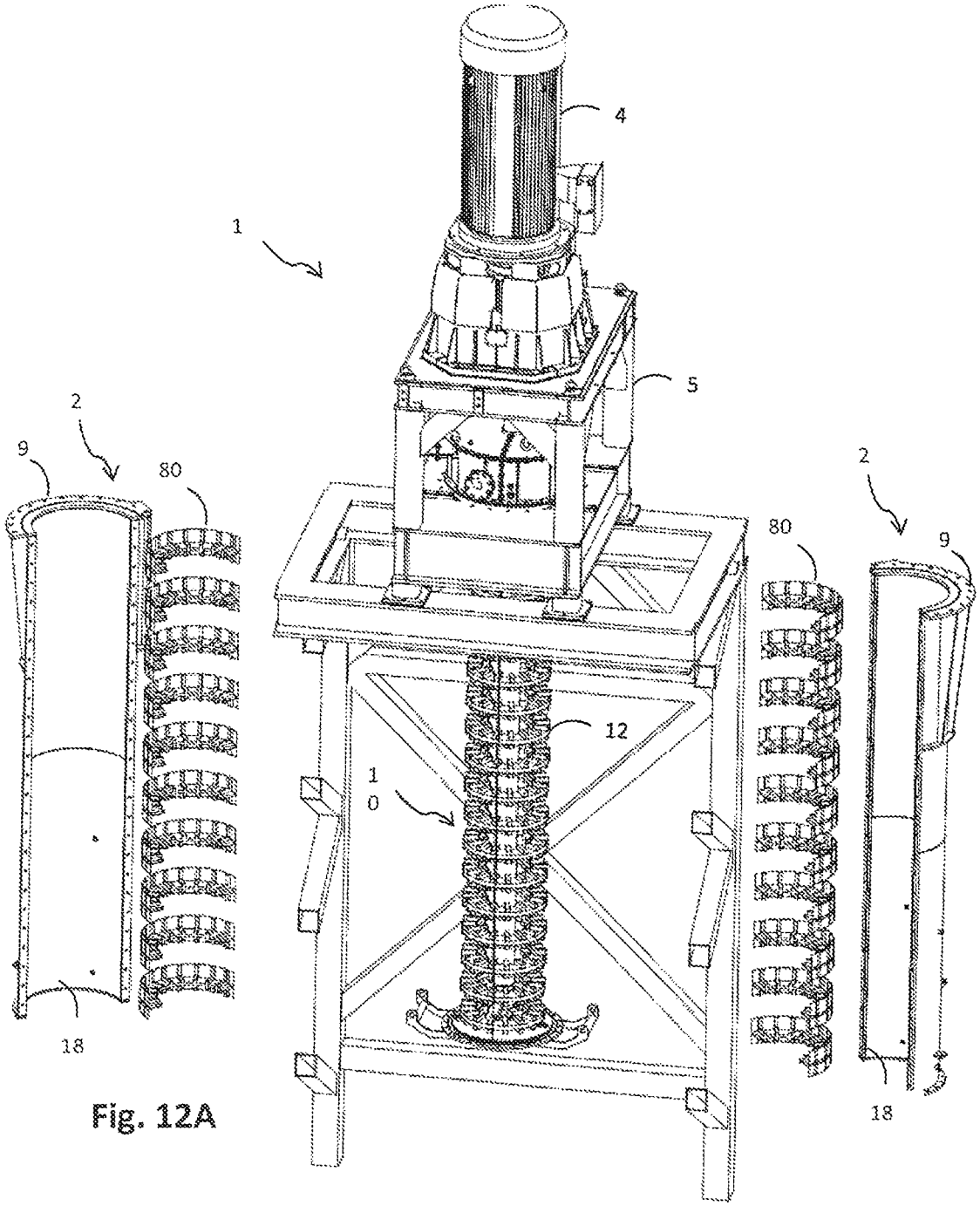
FIGS. 12A and 12B illustrate an exemplary installation of grinding elements according to exemplary embodiments into a grinding mill.
Figure 12B:
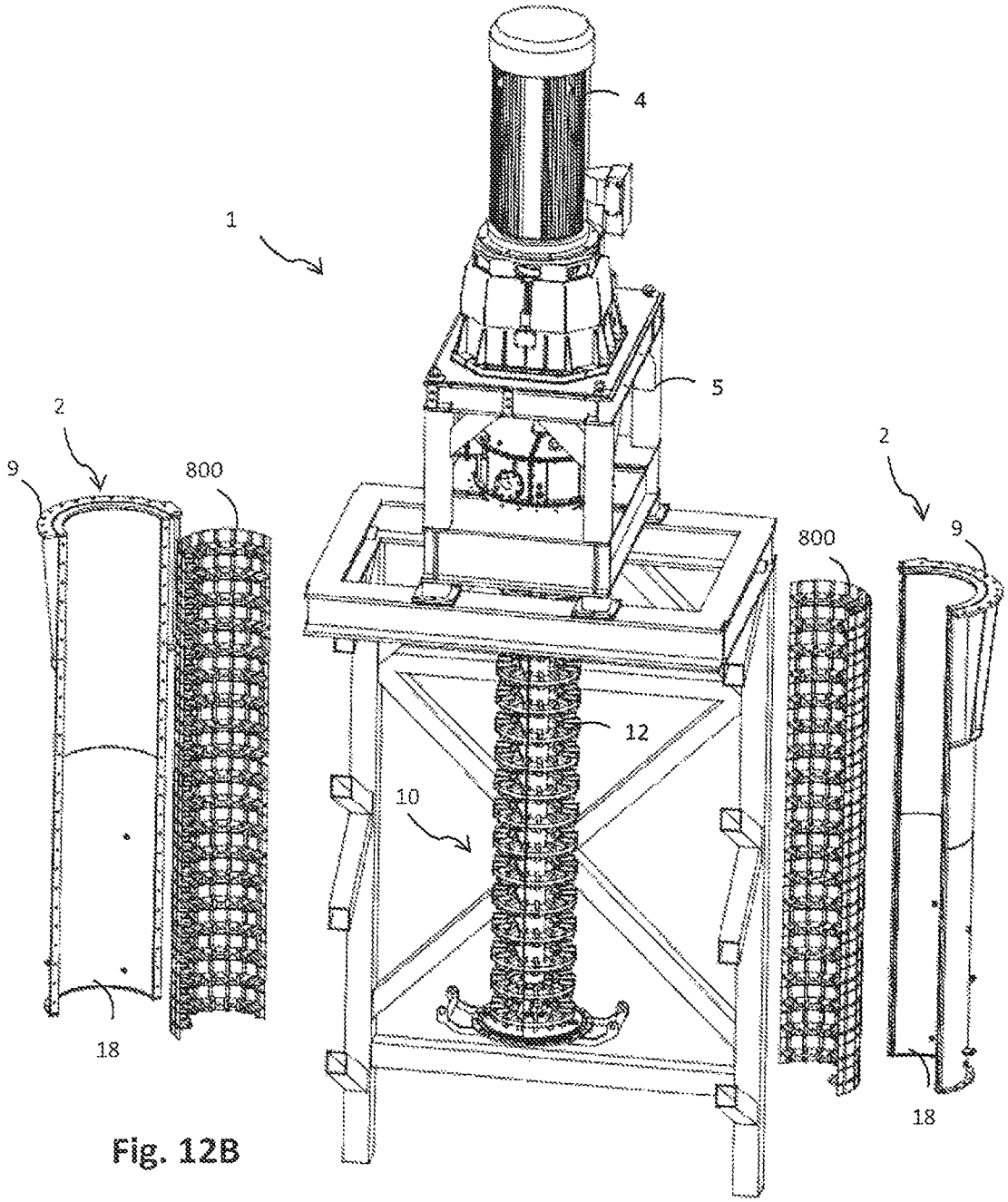

FIGS. 12A and 12B illustrate an exemplary installation of grinding elements 80 according to exemplary embodiments into a grinding mill 1, more specifically within a grinding mill shell 18 of a grinding mill body. In the illustrated example, the, the mill body 2 can be axially (e.g. vertically on a vertical mill and horizontally on a horizontal mill) split down the centre into two halves, or into three or more segments that can be moved apart. For example, the two halves of the mill body may be flanged axially (vertically) so that the can be separated. For example, the two halves of the mil body 2 may be hinged together, so that upon taking out flange bolts or like, the shell halves can be swung apart. After exposing the internals of the shell 18, the half-cylinder grinding elements 80 can be installed or mounted to the two halves of the mill body 2 within the shell 18. Also the grinding discs 12 can now be readily change, if desired. In the illustrated example, nine half-cylinder grinding elements 80 are stacked within each half of the mill body 2. Thereby, a half-cylinder grinding element assembly 800 is provided within each half of the mill body 2. The outer wall 81 of the grinding element 80 may be arranged to tightly or loosely fit against the inner surface of the shell to form a replaceable protective subshell which prevents the actual shell 18 from wearing. The grinding elements 80 or the grinding element 800 may be connected to the shell 18 by appropriate connecting means or they may be drop-in units. The halves of the mill body 2 containing the grinding elements 80 or grinding element assemblies 800 can now be connected together around the stirring shaft 11 and the grinding discs 12 to form a cylindrical drum 2 containing a subshell in a form of a cylindrical grinding element assembly. The actual shell 18 is fully protected from wearing. Worn grinding elements 80 can be easily replaced by a reverse procedure: the mill body 2 is separated into halves, the worn grinding elements 80 are selectively replaced, and the mill body is reassembled. In case of uneven wear of the grinding elements 80, individual worn grinding elements 80 can be replaced and unworn elements 80 can be left unchanged, which reduces the maintenance work and cost as well as spare part costs. As practically only the grinding elements 80 will wear, the lifetime of the mill body will be significantly prolonged.

As the castellation 25A and/or 25B on the grinding elements 80 typically wear out before the side wall 81 and the counter disc 14, it is possible to reuse a worn grinding element 80 by restoring the castellation 25A and/or 25B. The new castellation 25A and/or 25B can be provided by various means, including a 3D printing, for example. Alternatively the worn elements may be refurbished by welding to build up the worn areas (steel liners), replacement of worn castellation and/or counter discs by bolting/welding/riveting etc. Polymer liners could be built up by the addition of new polymer. Alternatively, worn areas may be repaired by attachment harder materials like ceramic or carbide tiles by gluing, cementing, bolting or any other means of attachment.

In the exemplary embodiments of the invention, the castellation is implemented by block shaped elements which is the preferred form. The castellation is not limited to the block-shaped elements but the castellation may be implemented by any form of projection that extends from the surfaces of the counter disc 14 or the sidewall 81. In embodiments, the axial profile and/or side profile of the castellation may comprise at least one or more of a projection, an elongated body, a block-shaped element, a flange, a tooth, a planar element, a vane, a blade, a fin, a plate, a bar, a post, a rod, a channel-shaped element, a V-shaped element, a U-shaped element, a ramp-like element and a wedge-shaped element. Yet another embodiment has angled or inclined annular shelves 14 instead of being orthogonal to the sidewall 81.

In embodiments, the castellation may be dimensioned to protrude from the sidewall and/or the counter disc 14 at a height that is at least one half of a size of the grinding media, preferably at least one and one half the size of the grinding media, more preferably at least 3 times the size of the grinding media. In embodiments, an inward height of the of the castellation may be within range of 2 mm to 200 mm, preferably within range of 5 mm to 150 mm depending on the size of mill or disc, more preferably within 10-100 mm.

The elements of the castellation may be spaced apart each other in the circumferential direction, or in in a direction of the rotational motion of the slurry of the grinding media and the particulate material. In embodiments, the spaced castellation elements are at intervals a of 10-60 degrees in a direction of the rotational motion of the slurry of the grinding media and the particulate material, preferably at intervals of 10-45 degrees, more preferably at intervals of 10-30 degrees, even more preferably at intervals of 10-20 degrees. In embodiments, a ratio of height of the cancellation elements to the spacing between the neighbouring castellation elements may be within range of ½ to 1/20, preferably within range of ⅕ to 1/20, more preferably within range of ⅛ to 1/12.

In embodiment, the castellation elements 25A may comprise elongated castellation elements extending longitudinally between the shelves or counter discs 14 on the sidewall 81 of the grinding element 80. Longitudinally means that the elongated protective elements may extend in direction which is transverse or at an angle to the rotational motion of the slurry of the grinding media and the particulate material, or parallel or at an angle to the axial direction 6 of the mill body.

In an embodiment the elongated castellation elements 25A may extend longitudinally between the shelves or counter discs 14 on the sidewall 81 approximately parallel with the axis of the mill shell 18.

In a further embodiment the elongated castellation elements 25A may extend longitudinally on the sidewall 81 of the grinding element 80 approximately parallel with the axis of the mill shell 18.

In a vertical grinding mill the castellation elements 25A may be vertical elements, and respectively, in a horizontal grinding mill horizontal elements.

In embodiments, the elongated castellation elements 25A extending longitudinally between the shelves or counter discs 14 on the sidewall 81 of the grinding element 80 may be inclined or at an angle to the axial direction 6 of the mill shell 18.

In an embodiment, the elongated castellation elements 25A extending longitudinally between the shelves or counter discs 14 on the sidewall 81 of the grinding element 80 can be arranged follow a helical path about the axial direction 6 of the mill shell.

In other embodiments, any other alternative longitudinal shapes of the elongated castellation elements 25A may be utilized.

In an embodiment, the elongated castellation elements 25A extending longitudinally between the shelves or counter discs 14 on the sidewall 81 of the grinding element 80 only traverse a portion of the distance between the shelves or counter discs 14.

In an embodiment, the elongated castellation elements 25A extending longitudinally between the shelves or counter discs 14 on the sidewall 81 of the grinding element 80 may each comprise two or more castellation element segments cascaded in line or in other pattern. The castellation element segments may be block-shaped segments, or pole-shaped segments, or they may have any other shape, such as hexagonal, oval or any other polygonal shape, depending on an application.

In embodiments, the castellation elements 25A and 25B may have holes, interruptions or cut outs in order to allow sludge circulation around the castellation elements.

Figure 13:
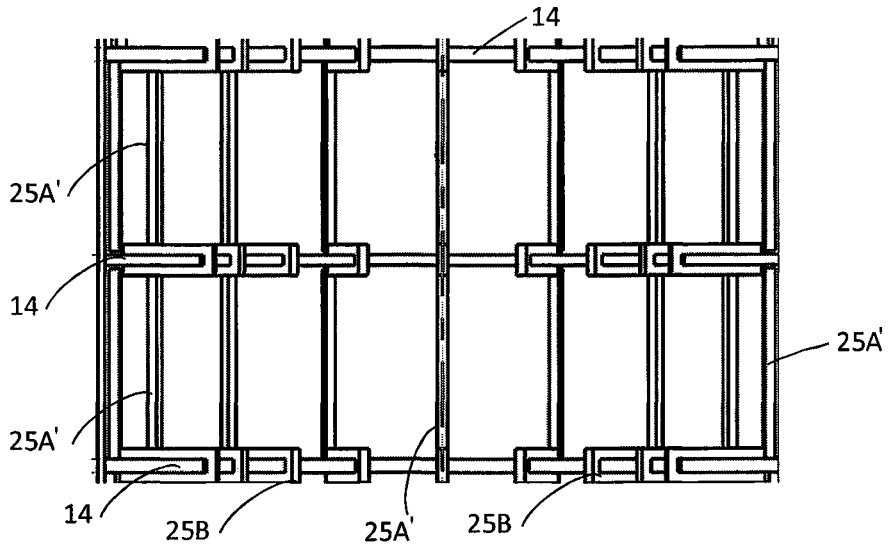
FIG. 13 is a side view of an exemplary grinding element having a cage-like structure.

In embodiments of the invention, a grinding element 80 may have a cage-like structure with axial support structure which comprises a plurality of elongated spaced support members 25A' defining the outer periphery of the grinding element 80, and at least one counter disc 14 is connected to and arranged to project radially inward from the plurality of elongated spaced support 30 members 25A' of the axial support structure, as illustrated in the example shown in FIG. 13. In the example of FIG. 13, the grinding element 80 has a crosssection of a hollow half-cylinder with three annular castellated shelves or counter discs 14. The exemplary grinding element 80 may be similar to a stack of three grinding elements 80 of FIG. 8, except that the sidewall 81 is omitted. In other 35 words, the members 25A' of axial support structure are interconnected by the shelves 14 so that a cage-like structure is obtained. Similarly, a cage-like grinding element 80 can be achieved from other embodiments disclosed above by omitting the sidewall 81. Otherwise, various embodiments and features described above are applicable also in embodiments having a cage-like structure. The elongated spaced support members 25A' may also act as castellation for the shell 18 of the mill body. A 5 cage-like grinding element 80 does not protect the shell 18 as well as a grinding element 80 having a sidewall 81, but it is lighter in weight, easier to handle, and has lower manufacturing cost.

Figure 14:
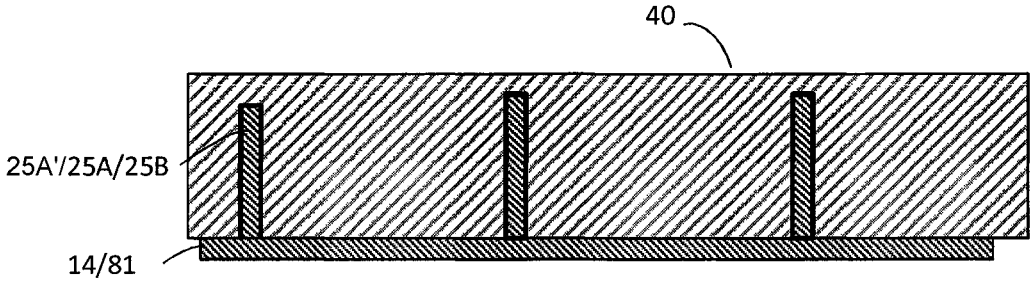
FIG. 14 is a cross-sectional side view of castellation elements embedded in a coating of a dissimilar sacrificial material.

Referring to FIG. 14, in yet another embodiment, one or more of the castellation elements 25A and 25B and the elongated spaced support members 25A' may act as a skeleton for coating with a dissimilar material 40. The coating of the dissimilar material 40 may be arranged to form a sacrificial protective layer over the castellation elements 25A and 25B and the inner surface of the sidewall 81. The sacrificial protective material 40 may be used for providing more easily replaceable integrated grinding elements 80, as the material 40 may make 15 the grinding element 80 more rigid. This may be particularly useful in embodiments having a cage-like structure. The sacrificial protective material 40 may also prolong the service life of the castellation elements 25A and 25B and the sidewall 81, although it may be arranged to wear off within a very short period of time after the installation and start of the grinding operation. The dissimilar material 20 may be polyurethane, for example. For example, grinding element 80 with the castellation elements 25A and 25B coated with or embedded in the sacrificial material 40 may appear as having a flat inner surface at the time of installation and obtain final shape during the operation after the sacrificial material 40 has worn out.

While the embodiments have been described with reference to a vertically arranged mill body and grinding mill, the invention may also be used in other mill types, such as grinding mills having a horizontally arranged or an angled mill body.

Furthermore, while the embodiments have been described with reference to grinding mills of the type that use stationary mill shells 18 or mill bodies 2 with rotating stirring shafts 11 and stirring elements 12, embodiments of the invention are also applicable to grinding mills of the type that use rotating mill shells 18 or mill bodies 2 with stationary stirring shafts 11 and stationary stirring elements 12 arranged in the grinding chamber 15. The rotating axis of the shell 18 or mill body 2 may be coaxial with the mill body 2, or non-coaxial. The rotating axis may be parallel to a longitudinal axis 6 of the mill body 2, or the rotating axis may be inclined or at an angle to the axis of the mill body.

Still further, embodiments of the invention are also applicable to grinding mills of the type that use rotating mill shells 18 or mill bodies 2 and rotating stirring shafts 11 and stirring elements 12 arranged in the grinding chamber 15. The rotating axis of the shell 18 or mill body 2 may be coaxial with the rotating axis of the stirring shaft 11, or non-coaxial. The rotating axis of the shell 18 or mill body 2 may be parallel to the rotating axis of the stirring shaft 11, or the rotating axis of the shell 18 or mill body 2 may be inclined or at an angle to the rotating axis of the stirring shaft 11.

It will further be appreciated that any of the features in the exemplary embodiments of the invention can be combined together and are not necessarily applied in isolation from each other. For example, different types of grinding elements 80 may be used in the same mill shell. Some grinding element 80 may have the castellation 25A and/or 25B while other grinding elements 80 may be without the castellation 25A and/or 25B. The shear forces and wear are typically highest at the bottom part of the shell, and the castellation 25A and/or 25B may thus preferably be provided at least to the bottom part of the shell.

Similar combinations of two or more features from the above described embodiments or preferred forms of the invention can be readily made by one skilled in the art.

The grinding elements according to embodiments of the invention may create a protective layer or zone of the grinding media against the wearable components, the invention reduces the amount of wear and thus prolongs the operational life of the components of the grinding mill, reducing maintenance time, costs and improving efficiency of the grinding mill. The protective layer or zone generated by the castellation may also promotes slurry particle contact with the grinding media, also improving grinding efficiency. Thus, the grinding mill is able to operate more efficiently, consuming components such as grinding discs at lower rates while grinding at faster rates. Moreover, the can be readily retrofitted in existing fine grinding mills. In all these respects, the invention represents a practical and commercially significant improvement over the prior art.

Although the invention has been described with reference to specific examples, it will be appreciated by those skilled in the art that the invention may be embodied in many other forms.

The invention claimed is:

1. A grinding element, comprising:

an axial support structure arranged to form an outer periphery of the grinding element adapted to fit within a cylindrical grinding shell of a stirred bead grinding mill used in grinding mineral ore particles, and at least one counter disc arranged to project radially inward from the axial support structure to an extent separating grinding zones within the cylindrical grinding shell in an axial direction while allowing a central stirring shaft to be installed within the cylindrical grinding shell, wherein at least part of the at least one counter disc is provided with a protective castellation configured to capture and create a protective layer or zone of grinding beads against the at least one counter disc and thereby reducing wear.

2. The grinding element of claim 1, wherein the grinding element has a cross-section of a hollow cylinder or an arc segment of a hollow cylinder.

3. The grinding element of claim 1, wherein the grinding element is dimensioned to be installed side by side with one or more further grinding elements in a radial plane within the grinding shell to form a grinding element assembly with a cross-section of a hollow cylinder.

4. The grinding element of claim 1, wherein the grinding element has an axial length that is smaller than the axial length of the cylindrical grinding shell.

5. The grinding element of claim 1, wherein the grinding element is dimensioned to be stacked up with one or more further grinding elements in the axial direction within the cylindrical grinding shell to form a grinding element assembly having a desired total axial length.

6. The grinding element of claim 1, wherein the at least one counter disc is arranged to project radially inward from the axial support structure at an axial location which is offset from axial locations of axially spaced stirring elements provided along the central stirring shaft.

7. The grinding element of claim 1, wherein the axial support structure comprises an axial sidewall defining an outer peripheral surface of the grinding element, and wherein the at least one counter disc is arranged to project radially inward from an inner surface of the axial side wall.

8. The grinding element of claim 7, wherein the axial support structure further comprises a plurality of spaced wear-protective elements provided along the inner surface of the axial sidewall of the support structure and protruding inwardly from said inner surface.

9. The grinding element of claim 1, wherein the grinding element has a cage structure, and wherein the axial support structure comprises a plurality of elongated spaced support members defining the outer periphery of the grinding element, and the at least one counter disc is connected to and arranged to project radially inward from the plurality of elongated spaced support members of the axial support structure.

10. The grinding element of claim 9, wherein the plurality of elongated spaced support members is arranged to form a skeleton for a lining of a dissimilar material, said lining being arranged to be sacrificed during a grinding operation in order to expose the elongated spaced support members.

11. The grinding element of claim 1, wherein the grinding element is a stand-alone element adapted for a loose fit mounting within the cylindrical grinding shell.

12. The grinding element of claim 1, wherein the grinding element is connectable to one or more further grinding elements to form a larger stand-alone grinding element assembly adapted for a loose fit mounting within the cylindrical grinding shell.

13. The grinding element of claim 1, wherein the at least one counter disc has an inner peripheral surface that defines a central annular opening through the at least one counter disc configured for passage of the central stirring shaft.

14. The grinding element of claim 13, wherein the protective castellation includes:

a plurality of first ribs circumferentially spaced from one another about the central annular opening and projecting upwardly from an upper surface of the at least one counter disc; and a plurality of second ribs circumferentially spaced from one another about the central annular opening and projecting downwardly from a lower surface of the at least one counter disc.

15. The grinding element of claim 14, further comprising another protective castellation including a plurality of third ribs circumferentially spaced from one another about the central annular opening and projecting radially inward from the axial support structure.

16. The grinding element of claim 15, wherein the plurality of third ribs are radially aligned with the corresponding plurality of first ribs.

17. The grinding element of claim 15, wherein the axial support structure is an annular side wall having a top portion extending upwardly from the at least one counter disc, and a bottom portion extending downwardly from the at least one counter disc.

18. The grinding element of claim 17, wherein the plurality of third ribs protrude radially inward from the top portion of the annular side wall, the another protective castellation further including a plurality of fourth ribs circumferentially spaced from one another about the central opening and protruding radially inward from the bottom portion of the annular side wall.

19. A grinding element assembly, comprising:

a plurality of grinding elements, each grinding element comprising:

an axial support structure arranged to form an outer periphery of the grinding element adapted to fit within a cylindrical grinding shell of a stirred bead grinding mill used in grinding mineral ore particles, and at least one counter disc arranged to project radially inward from the axial support structure to an extent separating grinding zones within the cylindrical grinding shell in an axial direction while allowing a central stirring shaft to be installed within the cylindrical grinding shell, wherein at least part of the at least one counter disc is provided with a protective castellation configured to capture and create a protective layer or zone of grinding beads against the at least one counter disc and thereby reducing wear.

20. A stirred bead grinding mill configured for use in grinding mineral ore particles, comprising:

an elongated grinding shell, a central stirring shaft within the grinding shell, and at least one grinding element that comprises:

an axial support structure arranged to form an outer periphery of the grinding element adapted to fit within the grinding shell, and at least one counter disc arranged to project radially inward from the axial support structure to an extent separating grinding zones within the grinding shell in an axial direction while allowing the central stirring shaft to extend within the grinding shell, wherein at least part of the at least one counter disc is provided with a castellation configured to capture and create a protective layer or zone of grinding beads against the at least one counter disc and thereby reducing wear.

* * * * *